US007037388B2

(12) United States Patent
Kan et al.

(10) Patent No.: US 7,037,388 B2
(45) Date of Patent: May 2, 2006

(54) STEEL PLATE FOR PAINT USE AND MANUFACTURING METHOD THEREOF

(75) Inventors: Toshiaki Kan, Kakogawa (JP); Shigeo Okano, Kakogawa (JP); Satoru Takeshita, Kakogawa (JP); Masahiko Sakai, Kakogawa (JP)

(73) Assignee: Kobe Steel, Ltd., Kobe (JP)

( * ) Notice: Subject to any disclaimer, the term of this patent is extended or adjusted under 35 U.S.C. 154(b) by 182 days.

(21) Appl. No.: 10/265,646

(22) Filed: Oct. 8, 2002

(65) Prior Publication Data

US 2003/0136483 A1 Jul. 24, 2003

Related U.S. Application Data

(63) Continuation of application No. 09/408,124, filed on Sep. 29, 1999, now abandoned.

(30) Foreign Application Priority Data

Sep. 30, 1998 (JP) ..... 10-27716
Dec. 25, 1998 (JP) ..... 10-370422

(51) Int. Cl.
*C22C 38/42* (2006.01)
*C22C 38/54* (2006.01)

(52) U.S. Cl. ..... 148/332; 420/91

(58) Field of Classification Search ..... 148/332, 148/654; 420/91

See application file for complete search history.

(56) References Cited

U.S. PATENT DOCUMENTS 4,043,807 A 8/1977 Kirman
4,776,900 A 10/1988 Yano et al. ..... 148/12
5,129,966 A 7/1992 Rao
5,183,633 A 2/1993 Thierry et al.
5,304,259 A 4/1994 Miyakusu et al.
5,500,290 A 3/1996 Udagawa et al.
5,542,996 A 8/1996 Nagataki et al. ..... 148/652
5,634,968 A 6/1997 Kurebayashi et al. ..... 148/320
5,762,725 A 6/1998 Pichard et al. ..... 148/334
5,817,196 A 10/1998 Teracher et al. ..... 148/547
5,820,706 A 10/1998 Bellus et al. ..... 148/649
5,873,957 A 2/1999 Bano et al. ..... 148/330

(Continued)

FOREIGN PATENT DOCUMENTS

CH 133434 5/1990

(Continued)

OTHER PUBLICATIONS

Wisti, Michael and Hingwe, Mandar, "Tempering of Steel," from the ASM Handbook vol. 4: Heat Treating, pub. By ASM International, 1995, p. 121.

(Continued)

*Primary Examiner*—Roy King
*Assistant Examiner*—Harry D. Wilkins, III
(74) *Attorney, Agent, or Firm*—Oblon, Spivak, McClelland, Maier & Neustadt, P.C.

(57) ABSTRACT

A steel plate for paint use which contains C (0.12% or less), Si (1.0% or less), Mn (2.5% or less), P (0.05% or less), S (0.02% or less), and Cr (0.05% or less), Cu (0.05–3.0%), Ni (0.05–6.0%), Ti (0.025–0.15%), and Cu+Ni (0.50% or more), with $P_{CM}$ being 0.23% or less, in terms of mass %. Said steel plate may contain at least one additional component selected from B (0.0005–0.0030%), Al (0.05–0.50%), Ca (0.0001–0.05%), Ce (0.0001–0.05%), La (0.0001–0.05%), Nb (0.002–0.05%), V (0.01–0.10%), Zr (0.002–0.05%), and Mo (0.05–0.5%), in terms of mass %.

This steel plate provides good weldability as well as good painting durability in a salt-polluted environment.

15 Claims, 9 Drawing Sheets

U.S. PATENT DOCUMENTS

| | | | | |
|---|---|---|---|---|
| 5,900,078 | A | 5/1999 | Yakuwa et al. | 148/330 |
| 5,948,183 | A | 9/1999 | Okada et al. | 148/330 |
| 6,218,027 | B1 | 4/2001 | Yuse et al. | |
| 6,436,340 | B1 * | 8/2002 | Shiotani et al. | 420/92 |

FOREIGN PATENT DOCUMENTS

| | | | |
|---|---|---|---|
| CH | 183767 | | 5/1992 |
| EP | 0 792942 | | 9/1997 |
| JP | 53-22530 | A | 7/1978 |
| JP | 56-33991 | A | 8/1981 |
| JP | 58-25458 | A | 2/1983 |
| JP | 58-17833 | A | 4/1983 |
| JP | 58-39915 | A | 9/1983 |
| JP | 2-133480 | A | 5/1990 |
| JP | 02-254133 | A * | 10/1990 |
| JP | 6-21273 | A | 3/1994 |
| JP | 6-94367 | A | 4/1994 |
| JP | 6-264256 | A | 9/1994 |
| JP | 2572447 | B2 | 10/1996 |
| JP | 9-125224 | A | 5/1997 |
| JP | 9-165647 | | 6/1997 |
| JP | 11-071632 | A * | 3/1999 |

OTHER PUBLICATIONS

Properties and Selection: Irons, Steels, and High-Performance Alloys, Joseph R. Davis, et al., Metals Handbook, 10th ed., ASM International.

* cited by examiner

STEEL PLATE FOR PAINT USE AND MANUFACTURING METHOD THEREOF

This application is a Continuation of application Ser. No. 09/408,124 Filed on Sep. 29, 1999, now abandoned.

BACKGROUND OF THE INVENTION

1. Field of the Invention

The present invention relates to a steel plate to be used for steel structures (such as bridges and towers) which present difficulties in routine maintenance work such as repainting and also to a manufacturing method thereof. More particularly, the present invention relates to a steel plate to be used with a painted film in coastland or cold district where steel structures are subjected to salt damage by airborne salt or deicing salt (as an antifreezing agent scattered on the road) and also to a manufacturing method thereof.

2. Description on the Related Art

There are two kinds of corrosion-resistant steels specified in the Japanese Industrial Standards (JIS). They are corrosion-resistant hot-rolled steel for welded structures (designated as SMA, JIS G-3114) and highly corrosion-resistant rolled steel (designated as SPA, JIS G-3125). These steels contain Cr, Cu, Ni, P, etc. in an adequate amount. Such corrosion-resistant steels are also disclosed in Japanese patents mentioned later. Corrosion-resistant steels form a dense and excellently adhesive layer of stable rust thereon which protects them from corrosion. They have been widely used in inland areas.

Unfortunately, corrosion-resistant steels need a long time of 10 years or more until they form a layer of stable rust. Practically, they pose a problem of initial corrosion and rust-laden water. This is true particularly in Japan where the climate is warm and humid. Rust stabilization is common practice to prevent corrosion-resistant steels from posing landscape or environment with rust-laden water until they form stable rust when they are used without a painted film. This practice, however, merely avoids rust-laden water and hinders the formation of compact rust layer when steels are used in a salt-polluted environment.

Several means have been proposed to address the above-mentioned problems involved in corrosion-resistant steels. For example, resin painting on the surface of corrosion-resistant steel, which is intended to promote the formation of stable rust while isolating steel surface from its environment, is disclosed in Japanese Patent Publication Nos. 22530/1978, 33991/1981, 39915/1983, 17833/1983, and 21273/1994, and Japanese Patent Laid-open No. 133480/1990. A surface treating solution to promote the formation of stable rust, which contains $Fe_3O_4$ of scaly crystal structure, phosphoric acid, and butyral resin dissolved in a solvent, is disclosed in Japanese Patent Laid-open No. 133480/1990. A method of surface treatment for rust stabilization, which consists of applying a painting solution composed of more than one compound of P, Cu, Cr, N, Si, and Mo, $Fe_2O_3$+$Fe_3O_4$, phosphoric acid, a bisphenol epoxy resin, and auxiliaries dissolved in a solvent, is disclosed in Japanese Patent Publication No. 21273/1994. The above-mentioned means, however, neither improve the corrosion-resistant steels themselves nor promote the formation of stable rust satisfactorily. In other words, a resin painted film usually has minute defects at which the film effect is not produced. Such defects cause corrosion to take place in the interface between the painted film and base metal, with the result that the painted film exfoliate before the stable rust layer is formed. Therefore, the use of corrosion-resistant steel is limited in the salt-polluted environment.

In the meantime, an important subject in the world of bridge is to save maintenance cost for repainting as well as construction cost. The latter object is achieved by reducing the number of main girders, adopting rationalized girders, reducing the frequencies of site welding, and reducing maintenance management. This stimulates a demand for steel with large thickness and high strength capable of welding with a large amount of heat input which obviates preheating to prevent cold cracking at the time of welding.

OBJECT AND SUMMARY OF THE INVENTION

The present invention was completed in order to address the above-mentioned problems. Accordingly, it is an object of the present invention to provide a steel plate for paint use and a manufacturing method thereof, said steel plate imparting good durability to the painted film thereon when used in a salt-polluted environment and also being superior in weldability.

The gist of the present invention resides in a steel plate for paint use which contains C (0.12% or less), Si (1.0% or less), Mn (2.5% or less), P (0.05% or less), S (0.02% or less), Cr (0.05% or less), Cu (0.05–3.0%), Ni (0.05–6.0%), Ti (0.025–0.15%), Cu+Ni (0.50% or more), and $P_{CM}$ (0.23% or less), in terms of mass %.

The above-specified steel plate may contain at least one additional component selected from B (0.0005–0.0030%), Al (0.05–0.50%), Ca (0.0001–0.05%), Ce (0.0001–0.05%), La (0.0001–0.05%), Nb (0.002–0.05%), V (0.01–0.10%), Zr (0.002–0.05%), and Mo (0.05–0.5%), in terms of mass %.

The above-specified steel plate, with the Ti/C ratio higher than 4, is produced by hot-rolling in such a way that the heating temperature (T) is 850–1200° C. and the temperature at the end of rolling is 950° C. or lower, which is followed by air cooling or water cooling (at a cooling rate 1° C./s or higher), or by direct quenching from a temperature of $Ar_3$~950° C. or reheating-quenching from a temperature of $Ac_3$~950° C., and tempering.

The above-specified steel plate, with the Ti/C ratio 4 or lower, is produced by hot-rolling in such a way that the heating temperature (T) is $850 \leqq T \leqq (1200-50\times Ti/C)$° C. and the temperature at the end of rolling is $(Ar_3+50\times Ti/C+100\times Ni^2)$° C. or lower, which is followed by air cooling or water cooling (at a cooling rate 1° C./s or higher), or by direct quenching from a temperature at the end of rolling or reheating-quenching from a temperature of $(AC_3+50\times Ti/C+100\times Ni^2)$° C. or lower, and tempering. $P_{CM}$, $Ar_3$, and $Ac_3$ used above are defined as follows.

$$P_{CM}=C+Si/30+Mn/20+Cu/20+Ni/60+Cr/20+Mo/15+V/10+5B$$

$$Ar_3=910-310C-80Mn-20Cu-15Cr-55Ni-80Mo+0.35(t-8)$$

(where t represents the plate thickness.)

$$Ac_3=908-223.7C+438.5P+30.49Si+37.92V-34.43Mn-23Ni+2(100C-54+6Ni)$$

(where the term 2(100C−54+6Ni) is applicable only when it is positive.)

DESCRIPTION OF THE PREFERRED EMBODIMENTS

Figure 1:
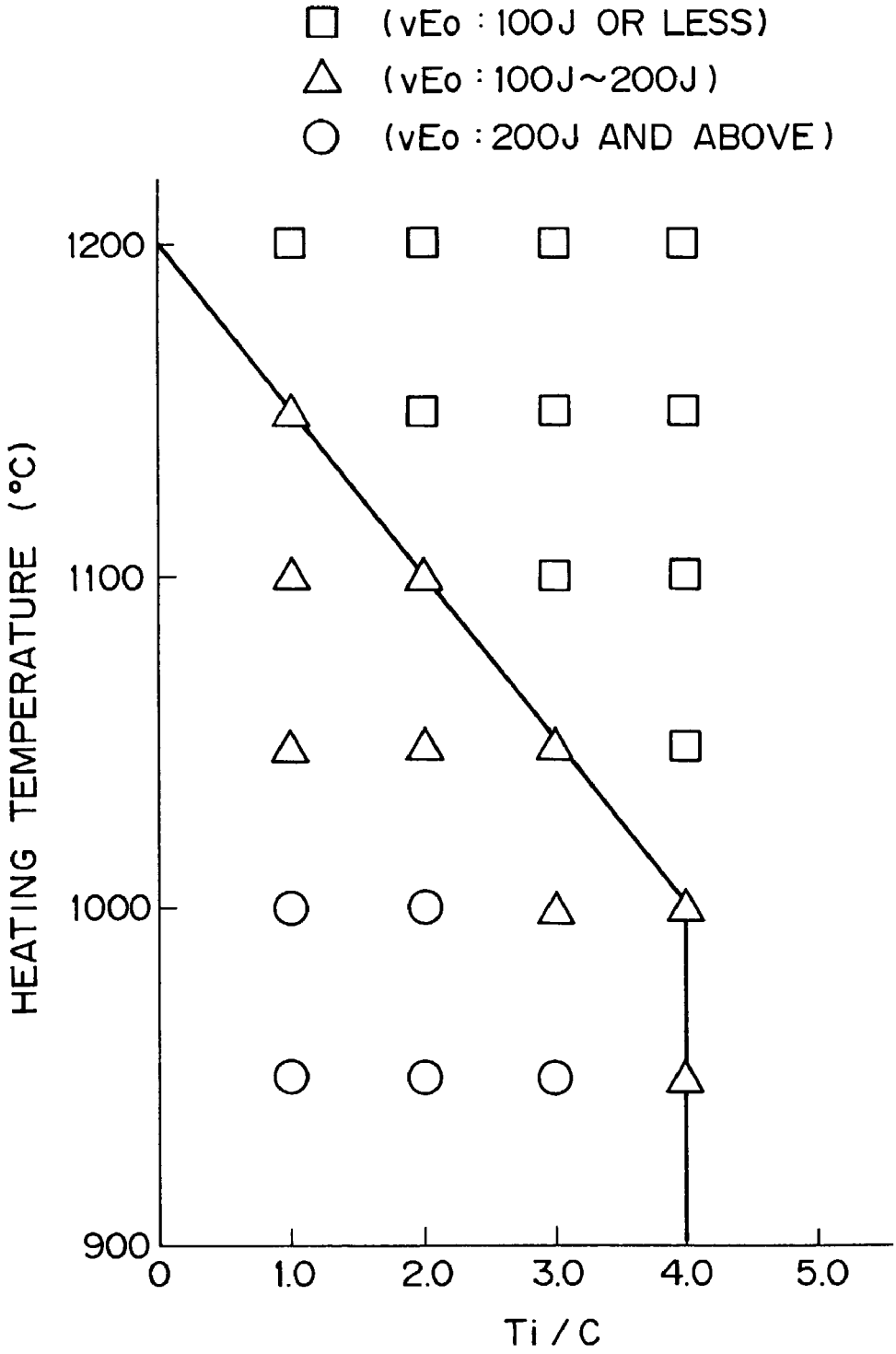
FIG. 1 is a graph showing how toughness is affected by the heating temperature and the Ti/C ratio.

It is known that if steel has a compact stable rust layer thereon, its corrosion only proceeds at a negligibly low rate even though it has no special anti-corrosion treatment, because the rust layer physically or electrochemically prevents corrosion-accelerating factors (such as moisture, oxygen, and chlorine ions present in the environment) from reaching the base metal (or steel) The corrosion-resistant steel effectively utilizes the action of self-corrosion resistance by compact rust.

To be concrete, it is possible to obtain the corrosion-resistant steel by adding such elements as Cr, Cu, Ni, and P, which promote the formation of compact rust, in very small amounts. In other words, corrosion-resistance steel produces its effect when it is used without a painted film. However, as mentioned earlier, the corrosion-resistant steel does not fully produce its effect of promoting the formation of stable rust when it is used in an environment severely contaminated with salt. Several means to cope with this situation have been devised. One of them is to paint the steel surface with a thin resin film so as to protect steel from salt until stable rust forms on the steel surface. However, the resin painted film is not satisfactory because of film defects as mentioned above.

The present inventors extensively studied the mechanism of corrosion in the defective part of a painted film. It was found that Cr as a steel component is a corrosion-accelerating element. In other words, it was found that when steel corrosion starts at the defective part of a painted film, Cr dissolves together with iron atoms, giving rise to Cr ions which, in conjunction with Cl ions, lower the pH in the defective part, thereby acidifying condensed water therein. The resulting acid water causes corrosion in the interface between the painted film and the base metal.

It is concluded from the mechanism of corrosion just mentioned above that it is important to take into account the following three points for improvement in durability of resin-painted corrosion-resistant steel in salt-polluted areas.

(1) Reduce the amount of Cr as far as possible so as to remove the corrosion-accelerating element in the defective part in a painted film.

(2) Add an element, in place of Cr, which promotes the formation of stable rust. (Since a painted steel has its base protected from salt by the painted film, it will have a long life even in a corrosive environment so long as it contains an element which prevents the pH from decreasing in the defective part of the painted film.)

(3) Add an element which moderates the decrease of pH in the defective part of a painted film or which rather increases pH when dissolved.

If the above-mentioned requirements are met, steel will form stable rust in the defective part of the painted film. Painting a common organic resin is recommended because of economy, workability, and simplicity. Among various resins (such as polyester, epoxy, and urethane), butyral resin is the best because of its toughness, flexibility, impact strength, and good adhesion to metal.

The steel for paint use will permit reduction in the number of main girders and adoption of rationalized girders, which leads to cost reduction in bridge construction, if it has good weldability, good low-temperature toughness, sufficient thickness, and high strength. For the steel plate to have good weldability, it is necessary to control the C content and the weld cracking parameter of material $P_{CM}$. For the steel plate to have good toughness, it is necessary to control the precipitation of TiC or to specify the heating, rolling, and heat-treating conditions according to the Ti/C ratio. For the steel plate to have sufficient thickness and high strength, it is necessary to add B, Nb, V, Zr, and Mo. For the steel plate to have good toughness at the part affected by welding heat and to be capable of welding with a large amount of heat, it is necessary to specify the upper limit of the content of C and Ti and to effectively utilize B.

The present invention is based on the above-mentioned ideas. Mention is made below of the effect of each composition and the reason why the amount of each composition is limited.

Regarding Cu, Ni, and Ti as essential elements for the corrosion-resistant steel.

Cu is an element which is electrochemically nobler than iron. It forms compact rust and grows stable rust. It produces its effect when it is contained in an amount of 0.05% or more. Its effect levels off when its content exceeds 3.0%. With an excess amount, it makes the steel brittle at the time of hot rolling. Therefore, the adequate content of Cu should be 0.05–3.0%.

Ni is an element which, like Cu, improves corrosion resistance. It produces its effect when it is contained in an amount of 0.05% or more. In addition, Ni prevents hot brittleness which may occur if Cu is contained. Its effect levels off when its content exceeds 6.0%. Therefore, the adequate content of Ni should be 0.05–6.0%.

Figure 7:
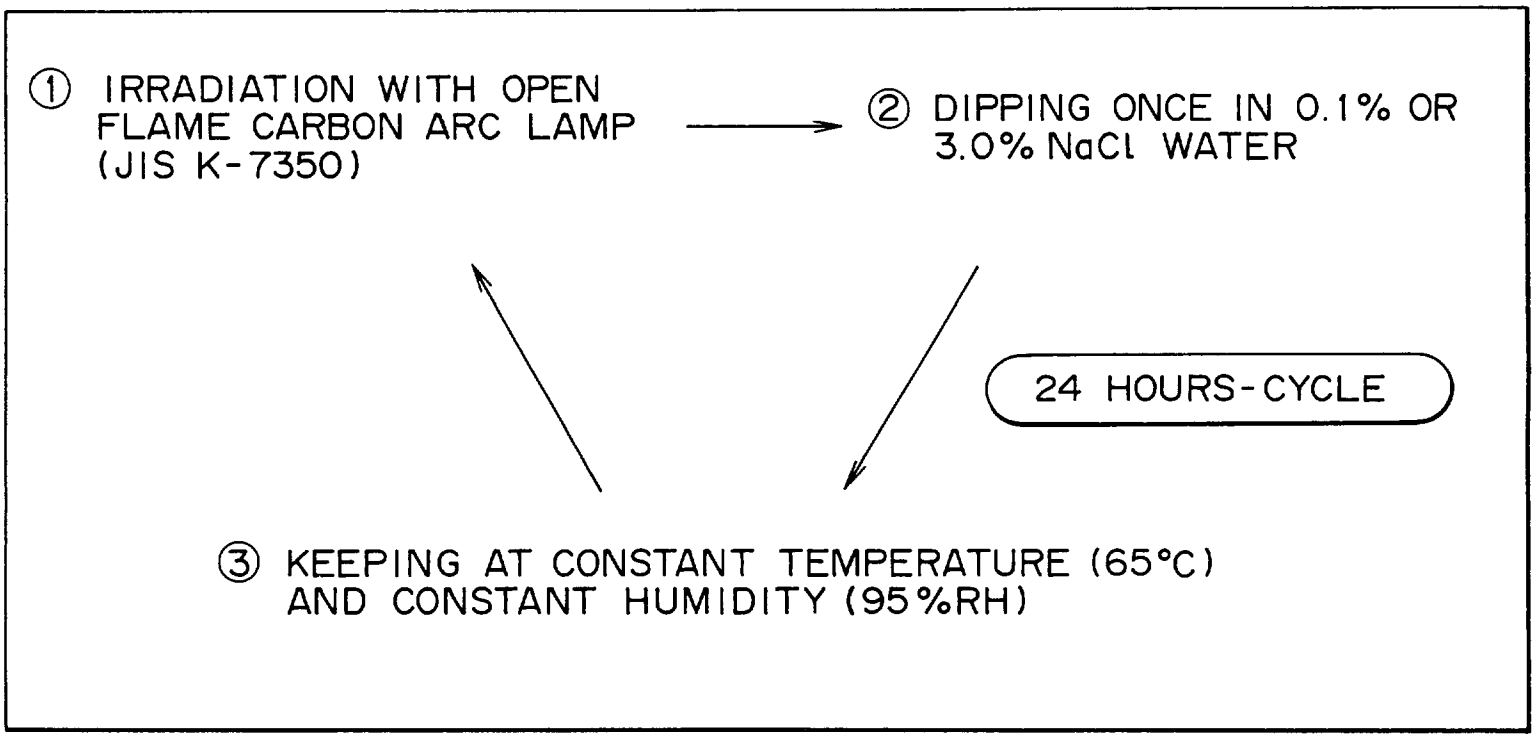
FIG. 7 is a figure illustrating the cycle of accelerated tests.
Figure 8:
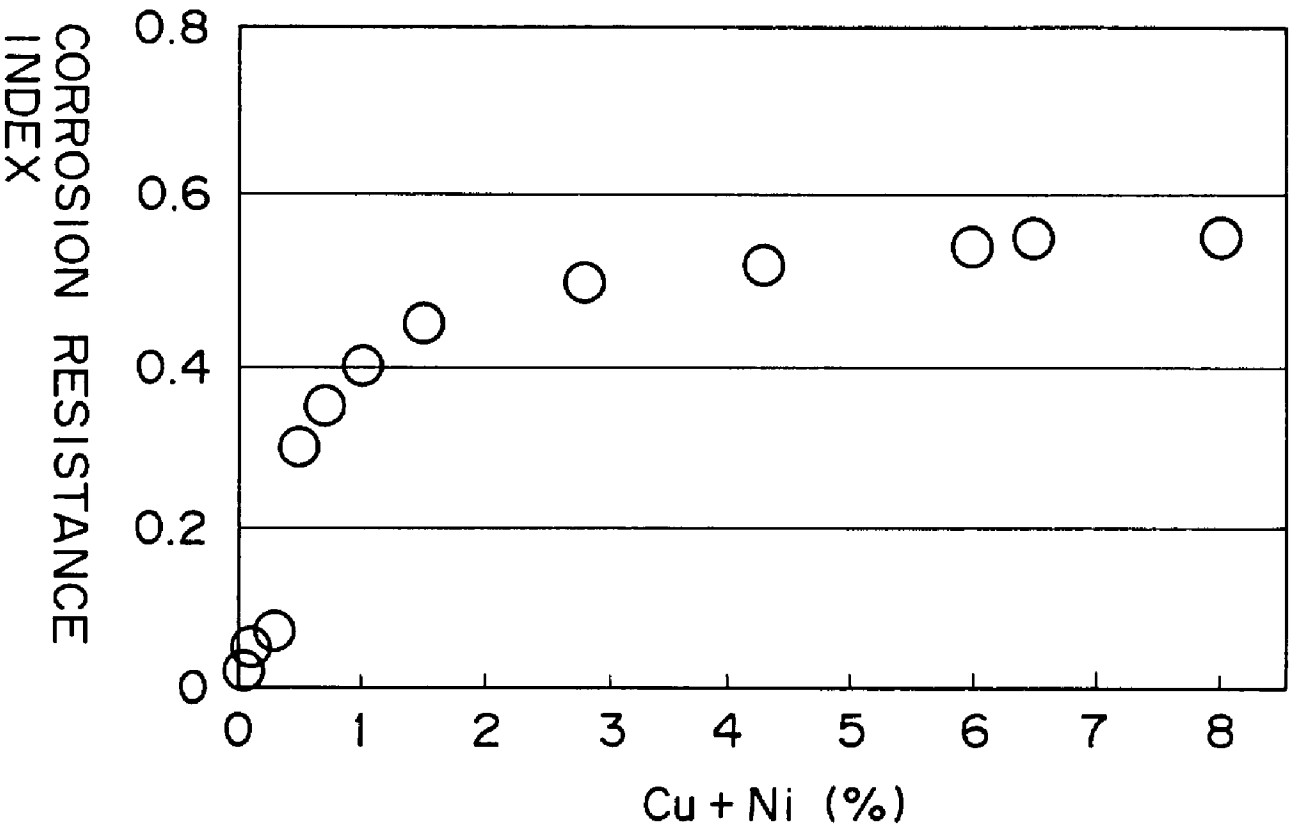
FIG. 8 is a graph showing the relation between the corrosion resistance and the total amount of Cu+Ni.

In addition, the present invention requires that the total amount of Cu+Ni be 0.50% or more. FIG. 8 shows the relation between the total amount of Cu+Ni and the corrosion resistance, which was found by the present inventors' experiment with the sample according to Claim 1. The test method is shown in FIG. 7. The test result was rated in terms of the width of blistering at the defective part of painted film. In FIG. 8, the corrosion resistance index is indicated by 1−a (where a is the average width (mm) of blistering). The larger the index, the better the corrosion resistance. It is apparent from FIG. 8 that the corrosion resistance increases according as the total amount of Cu+Ni increases. Good effects are produced when the total amount of Cu+Ni is 0.50% or more.

Ti is an essential element to supersede Cr which was selected under the idea mentioned in (2) above. Like Cr, Cu, and Ni, this element forms compact rust and grows stable rust. It also provides outstanding corrosion resistance and produces the effect of purifying steel. These effects are remarkable when the content is 0.025% or more. With its content exceeding 0.15%, Ti does not produce any additional effect but rather aggravates the toughness of the part affected by welding heat. Therefore, the adequate content of Ti should be 0.025–0.15%.

Figure 9:
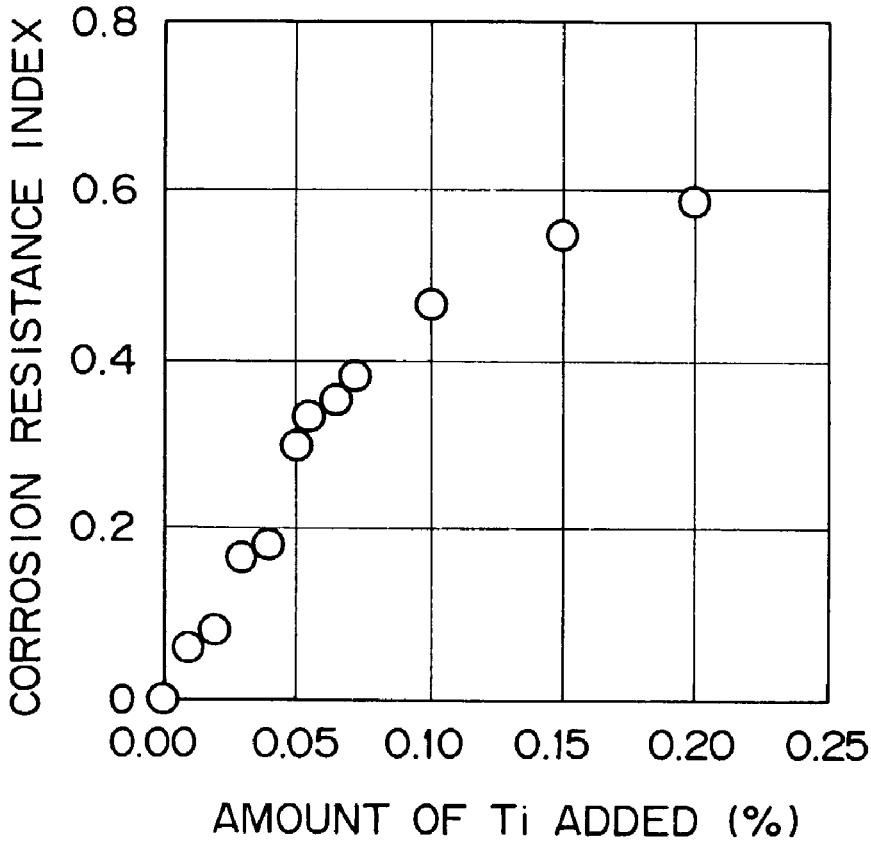
FIG. 9 is a graph showing the relation between the corrosion resistance and the amount of Ti added.

FIG. 9 shows the relation between the content of Ti and the corrosion resistance, which was found by the present inventors' experiment with the sample according to Claim 1. The test method and the rating of the test result are the same as mentioned above. It is apparent from FIG. 9 that the corrosion resistance increases according as the content of Ti increases. Good effects are produced when the content of Ti is 0.05% or more.

Mention is made below of the effect of P, Cr, C, Si, and Mn. P and Cr are necessary for conventional steels to be used without coating. Since they greatly aggravate weldability, their content is limited to 0.05% in the steel plate of the present invention which is used mainly for bridges and other structures that need site welding frequently. The content of Cr should not exceed 0.05%, because Cr decreases pH and acidifies condensed water in the defective part of painted film, thereby causing corrosion in the interface between the painted film and the base metal.

C is an essential element for the steel plate to have a desired strength. With an increasing content of C, the steel plate becomes poor in weldability and corrosion resistance. Therefore, the content of C should be 0.12% or less. Incidentally, for the steel plate to have satisfactory weldability and corrosion resistance, the content of C should be 0.10% or less. For good weldability, $P_{CM}$ should be 0.23% or less according to the present invention.

Si promotes solid-solution hardening, accelerates the formation of stable rust, and improves corrosion resistance. However, Si in an excess amount aggravates weldability. Therefore, the adequate content of Si should be 1.0% or less.

Mn provides strength, like C. A large amount of Mn in steel has an adverse effect on workability, toughness, and corrosion resistance (due to MnS formed from it). Therefore, the adequate content of Mn should be 2.5% or less.

S combines with Mn or Fe to form MnS or FeS, respectively. These compounds provides a starting point for corrosion. Therefore, the adequate content of S should be 0.02% or less.

Al, as well as Ti, is an element to supersede Cr which was selected under the idea mentioned in (2) above. Like Cr, Cu, and Ni, this element forms compact rust and grows stable rust. It produces its effect when its content is 0.05% or more. It produces an enhanced effect when used in combination with Ti. With an amount exceeding 0.50%, it produces no additional effect but rather aggravates the toughness of the base metal. Therefore, the adequate content of Al should be 0.05–0.50%.

Ca, Ce, and La are elements to moderate pH decrease in the defective part of painted film, which were selected under the idea mentioned above in (3). These elements slightly dissolve as the corrosion of iron proceeds under the painted film. They are alkaline and hence they moderate pH decrease, thereby preventing corrosion in the defective part in painted film. They produce their effect when they are present in an amount of 0.0001% or more. Their effect levels off even though their amount is increased. Therefore, their respective content should be 0.0001–0.05%.

B is an element which improves the hardenability and strength of steel and forms fine ferrite in the part affected by welding heat, thereby compensating for embrittlement due to TiC precipitation. An amount of 0.0005% or more is necessary for B to produce its effect. An excess amount more than 0.0030% aggravates weldability rather than enhancing the effect. Therefore, the content of B should be 0.0005–0.0030%.

Mention is made below of Mo, Nb, Zr, and V. These elements are added to thick steel plates (50 mm and above) and high-strength steel (590 N/mm$^2$ and above), but they produce very little effect on corrosion resistance.

Mo, as well as B, is an element which effectively increases the strength of steel. An amount of 0.05% or more is necessary for Mo to produce its effect. An excess amount more than 0.5% aggravates weldability rather than enhancing the effect. Therefore, the content of Mo should be 0.05–0.5%.

Nb and Zr are elements which form their carbo-nitrides to increase strength. They produce this effect when they are present in an amount of 0.002% or more. An excess amount more than 0.05% aggravates toughness rather than enhancing the effect. Therefore, the content of Nb and Zr should be 0.002–0.05% each.

V, as well as Nb and Zr, is an element which increases the strength of steel. An amount of 0.01% or more is necessary for it to produce its effect. An excess amount more than 0.10% aggravates toughness rather than enhancing the effect. Therefore, the content of V should be 0.01–0.10% each.

Mention is made below of the manufacturing method according to the present invention. The method of the invention is characterized in adding Ti in a large amount so that the steel exhibits good corrosion resistance when it is given coating. Unfortunately, Ti precipitates in the form of TiC, thereby greatly aggravating the toughness of the base metal. In the production of steel plates, it is important to suppress the deterioration of toughness due to TiC. There are two ways to achieve this object, (1) by preventing Ti from forming solid solution when steel is heated for hot rolling and quenching, or (2) by making dissolved Ti (in solid solution) harmless. The process of production was investigated in two ways according to the Ti/C ratio which is either greater than 4 or smaller than 4.

Incidentally, it is not necessary to investigate the deterioration of toughness due to TiC particles which have precipitated before heating for hot rolling or quenching, because the TiC particles are too large to affect toughness. In other words, those TiC particles which exist before heating for hot rolling are formed during air cooling after casting, and those TiC particles which exist before heating for quenching are formed during air cooling after hot rolling. Air cooling after casting is very slow because the slab is thick and hence the precipitated TiC particles grow and become large. In the case of hot rolling which ends at a high temperature and is followed by air cooling, TiC particles grow and become large. Such grown TiC particles do not affect toughness and hence they can be neglected.

Case 1 in which the Ti/C ratio is 4 or less and steel does not undergo quenching and tempering.

The effect of heating temperature was investigated to find the condition under which Ti does not form solid solution. Several steel samples were prepared, with the Ti/C ratio varied for the base composition of 0.05% C-0.55% Cu-0.50% Ni-0.05% Ti. In order to make dissolved Ti harmless, hot rolling was carried out in such a way that the finish rolling temperature (FRT) is 760° C. (which is close to $Ar_3$), with the heating temperature varied. Hot rolling, followed by air cooling, gave 25-mm thick steel plates. These steel plates were tested for toughness. The results are shown in FIG. 1. (The object of making dissolved Ti harmless is achieved if hot rolling is carried out to such an extent the low region of the temperature of Y solid solution is reached. Hot rolling at high temperature induces strain to precipitate TiC particles, which become coarser during subsequent rolling to such an extent that they do not match the matrix any longer. Thus it is possible to suppress the deterioration of toughness.)

FIG. 1 is a graph showing how toughness varies depending on the heating temperature and the Ti/C ratio. It is apparent from FIG. 1 that if the heating temperature (T) is (1200−50×Ti/C)° C. or more (in the region under the oblique line), the desired value of $vE_0 \geqq 100J$ is achieved. The lower limit of heating temperature is 850° C. in view of the productivity at the time of rolling, because steel is difficult to roll due to increased deformation resistance when the heating temperature is low.

Investigations were carried out into the finish rolling temperature which is adequate to make the dissolved Ti harmless. Several steel samples were prepared, with the Ti/C ratio varied for the base composition of 0.05% C-0.55% Cu-0.05% Ti. According to the present invention, the steel plate for coating is positively incorporated with Ni for improvement in toughness. To see the effect of Ni on toughness, two samples were tested, one containing 0.5% Ni and the other containing 1.0% Ni. Judging from the results mentioned above, the heating temperature was kept low at 1050° C., which is the lower limit available for the continuous heating furnace. Several kinds of 25-mm thick steel plates were prepared by hot rolling, followed by air cooling, with the finish rolling temperature varied. These samples were tested for toughness. The results are shown in FIGS. 2 and 3.

Figure 2:
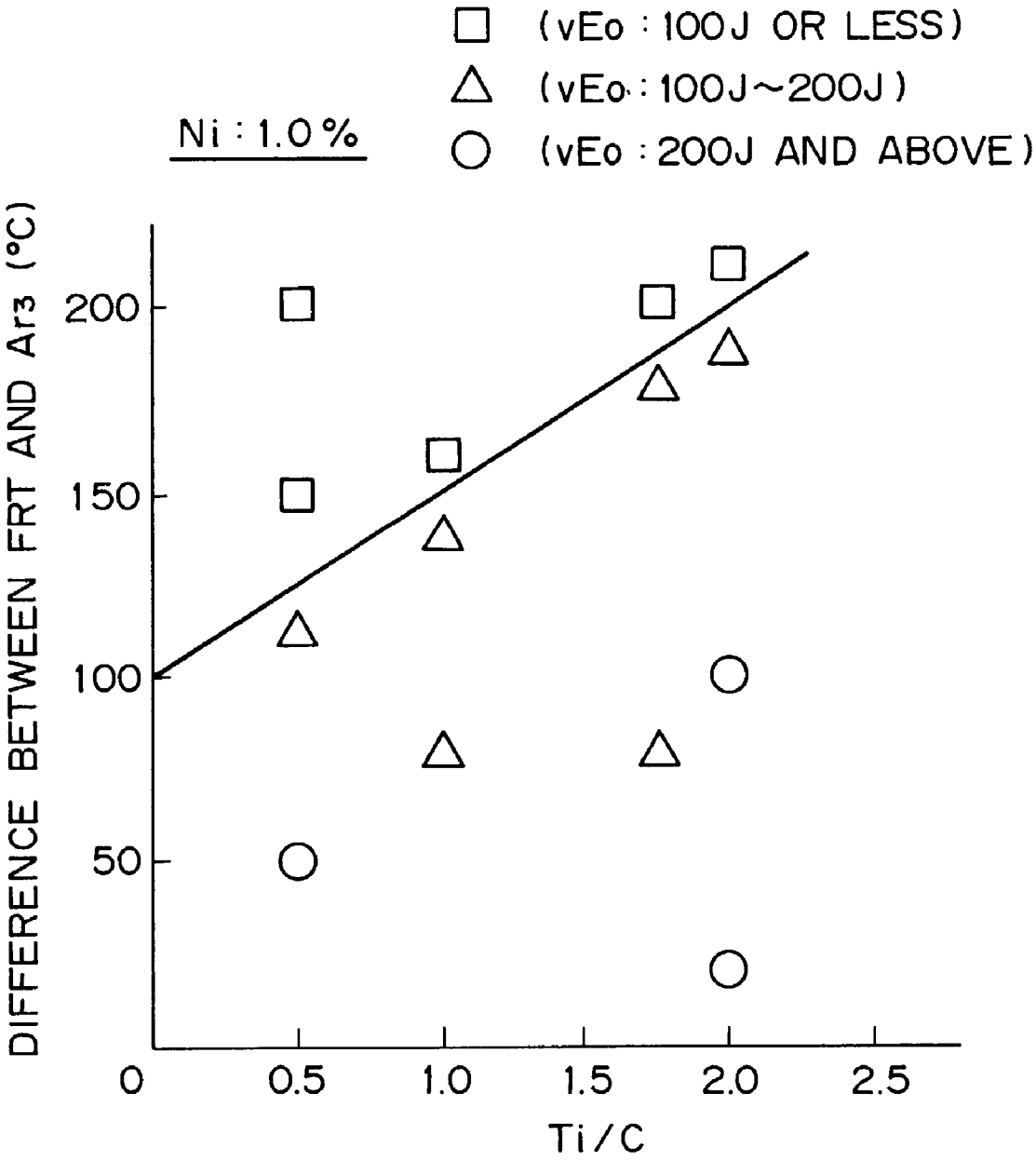
FIG. 2 is a graph showing how toughness is affected by the difference between FRT and $Ar_3$ and the Ti/C ratio, in the case where the amount of Ni is 1.0%.
Figure 3:
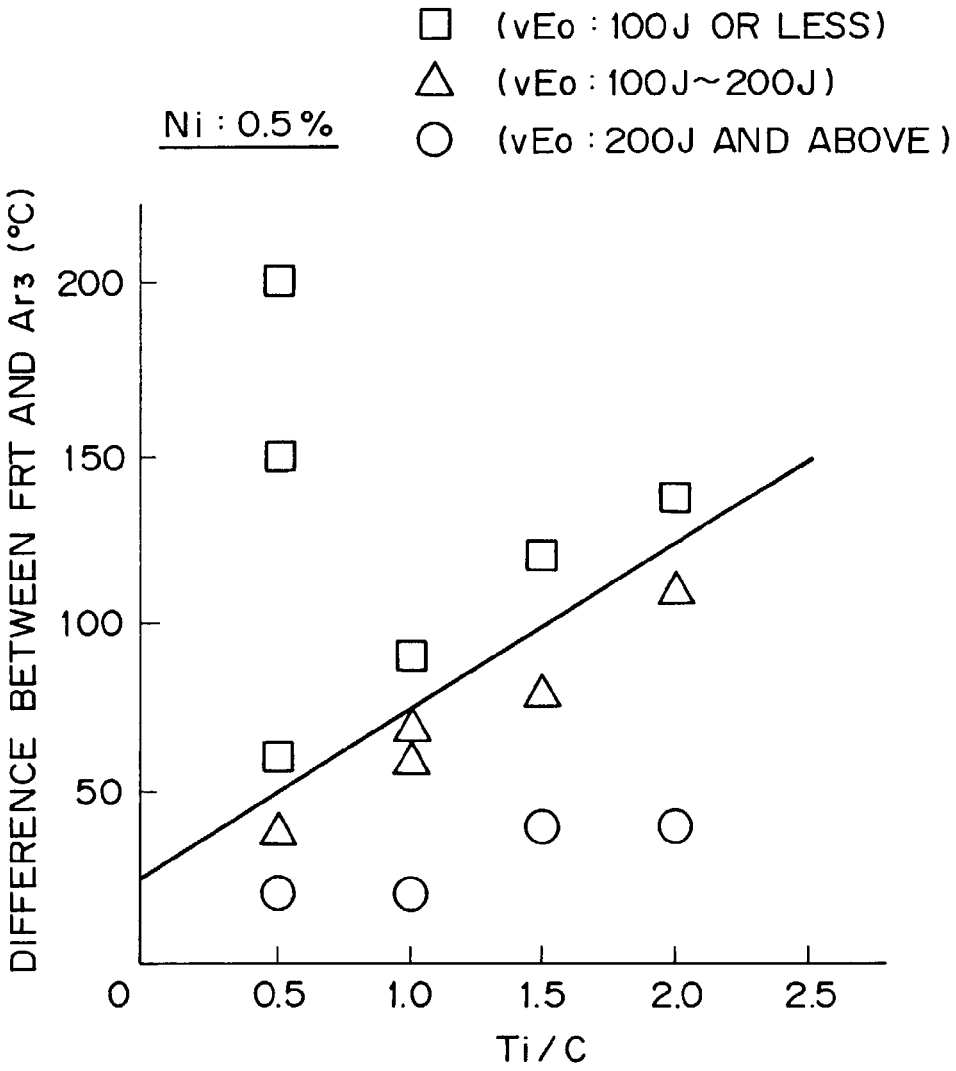
FIG. 3 is a graph showing how toughness is affected by the difference between FRT and $Ar_3$ and the Ti/C ratio, in the case where the amount of Ni is 0.5%.

FIGS. 2 and 3 show how toughness is affected by the difference between FRT and $Ar_3$ and the Ti/C ratio, with the amount of Ni kept at 1.0% or 0.5%. It is apparent from FIGS. 2 and 3 that if FRT is $(Ar_3+50\times Ti/C+100\times[Ni]^2)$° C. or lower (in the region under the oblique line), the desired value of $vE_0 \geqq 100J$ is achieved. For high toughness, FRT should preferably be 700–800° C.

Case 2 in which the Ti/C ratio is 4 or less and steel undergo quenching and tempering.

The effect of quenching and tempering temperature was investigated to find the condition under which Ti does not form solid solution. Several steel samples were prepared, with the Ti/C ratio varied for the base composition of 0.05% C-0.55% Cu-0.50% Ni-0.05% Ti. This steel was incorporated with 10 ppm of B. As in the case mentioned above, the amount of Ni was kept at 0.5% and 1.0%. Hot rolling was carried out such that the heating temperature is 1100° C. (which is generally applied to steels for welded structures) and the finish rolling temperature (FRT) is 850° C. Hot rolling, followed by air cooling, gave 25-mm thick steel plates.

The thus obtained steel plates underwent quenching at varied temperatures and tempering at 640° C. (which is applied to ordinary steels (570 $N/mm^2$) for welded structures). Quenching was carried out at a cooling rate of 20° C./s. The resulting samples were tested for toughness. The results are shown n FIGS. 4 and 5.

Figure 4:
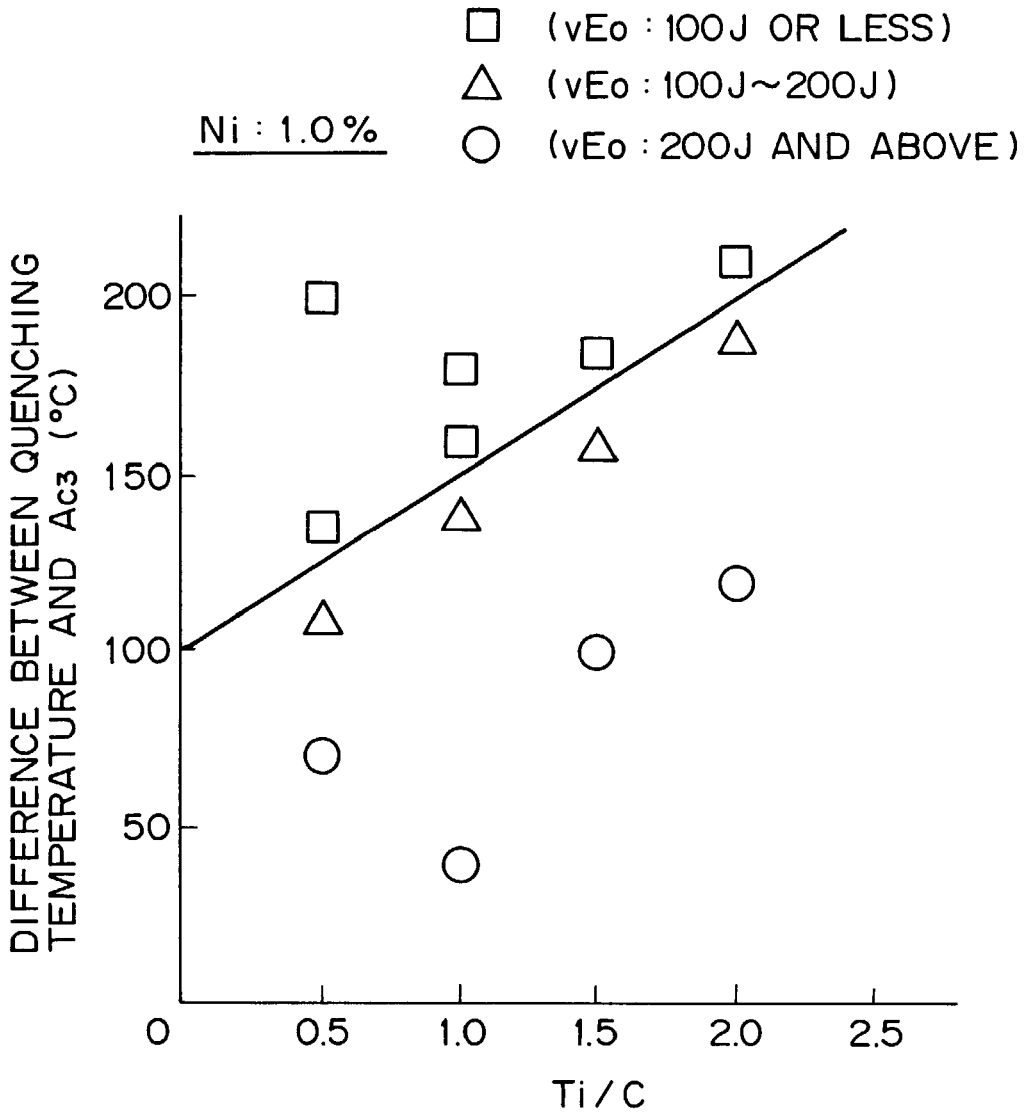
FIG. 4 is a graph showing how toughness is affected by the difference between the quenching temperature and $Ac_3$ and the Ti/C ratio, in the case where the amount of Ni is 1.0%.
Figure 5:
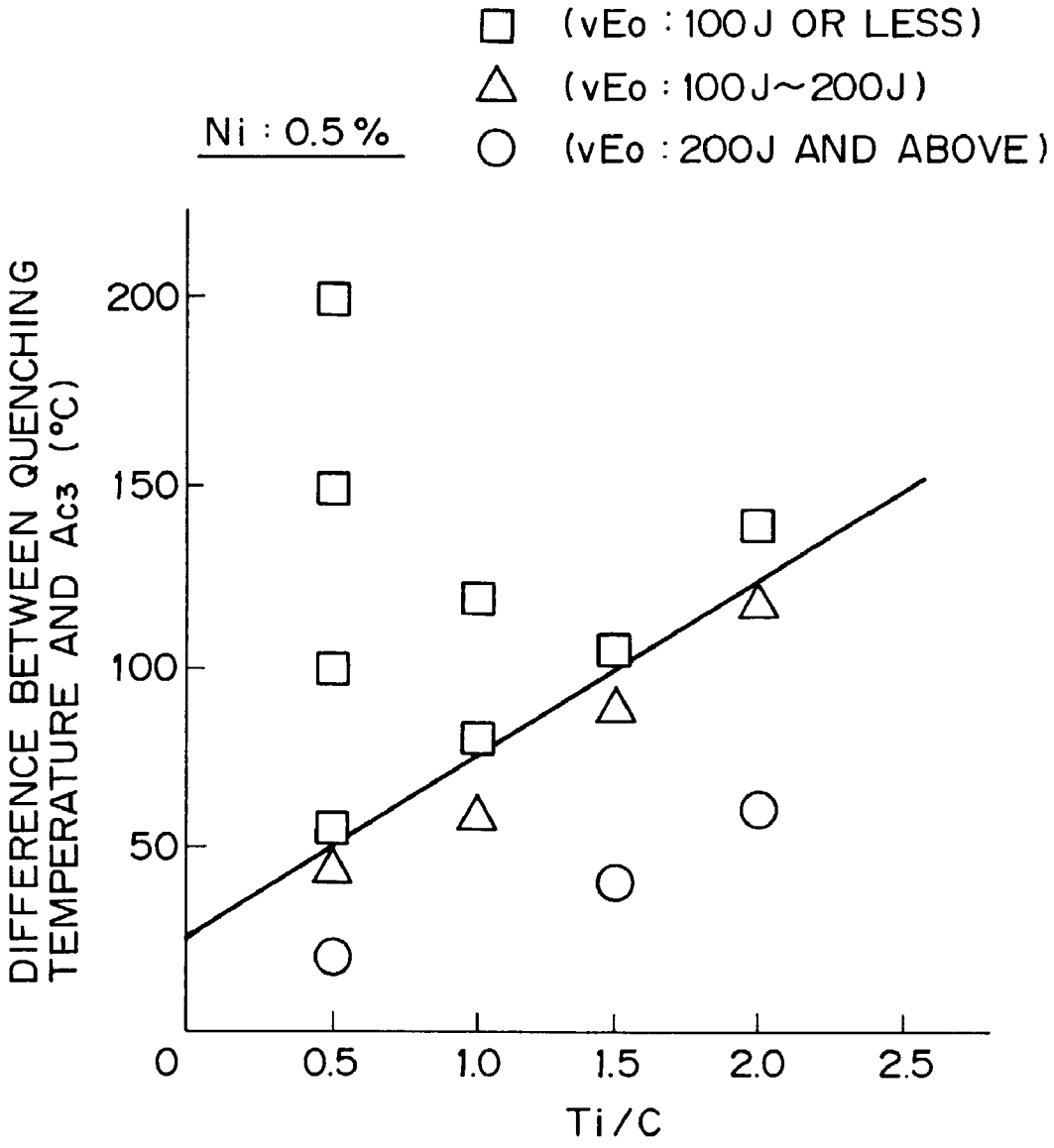
FIG. 5 is a graph showing how toughness is affected by the difference between the quenching temperature and $Ac_3$ and the Ti/C ratio, in the case where the amount of Ni is 0.5%.

FIGS. 4 and 5 show how toughness is affected by the difference between annealing temperature and $AC_3$ and the Ti/C ratio, with the amount of Ni kept at 1.0% or 0.5%. It is apparent from FIGS. 4 and 5 that if the quenching temperature is $(Ac_3+50\times Ti/C+100\times[Ni]^2)$° C. or lower (in the region under the oblique line), the desired value of $vE_0 \geqq 100J$ is achieved. For high toughness, the annealing temperature should preferably be 850–880° C.

The above-mentioned explanation of the quenching temperature is applicable to reheating-hardening. However, it is also applicable to direct quenching if the heating temperature and FRT are the same as those in the case where the Ti/C ratio is higher than 4, and the desired value of $vE_0 \geqq 100J$ is achieved as a matter of course. Hot rolling is followed by water cooling at a controlled cooling rate in view of the plate thickness in order to obtain the desired strength. In the case where high toughness is required, FRT should be 700–800° C. and hot rolling should be followed directly by quenching.

Case 3 in which the Ti/C ratio is higher than 4.

In the case where the Ti/C ratio is higher than 4, TiC precipitates incoherently in austenite (without deteriorating toughness), with very little coherent precipitation (which deteriorates toughness) in ferrite. Therefore, it is basically unnecessary to specify the heating temperature, FRT, and quenching temperature. In the present invention, they are specified as follows in consideration of production cost and productivity.

Heating temperature: 1200° C. as the upper limit (in consideration of fuel consumption) and 850° C. as the lower limit (in consideration of rolling productivity).

Finish rolling temperature (FRT): 950° C. as the upper limit (in consideration of strength). Improved strength needs fine crystal particles. For high toughness, FRT should preferably be 700–800° C.

Quenching temperature: 950° C. as the upper limit (in consideration of fuel consumption), and $AC_3$ as the lower limit (in consideration of strength). Hot rolling may be followed directly by quenching. However, there may be an instance where it is necessary to carry out quenching in the two-phase region in order to achieve a low yield ratio.

EXAMPLE 1

The invention will be described with reference to the following examples.

Figure 6:
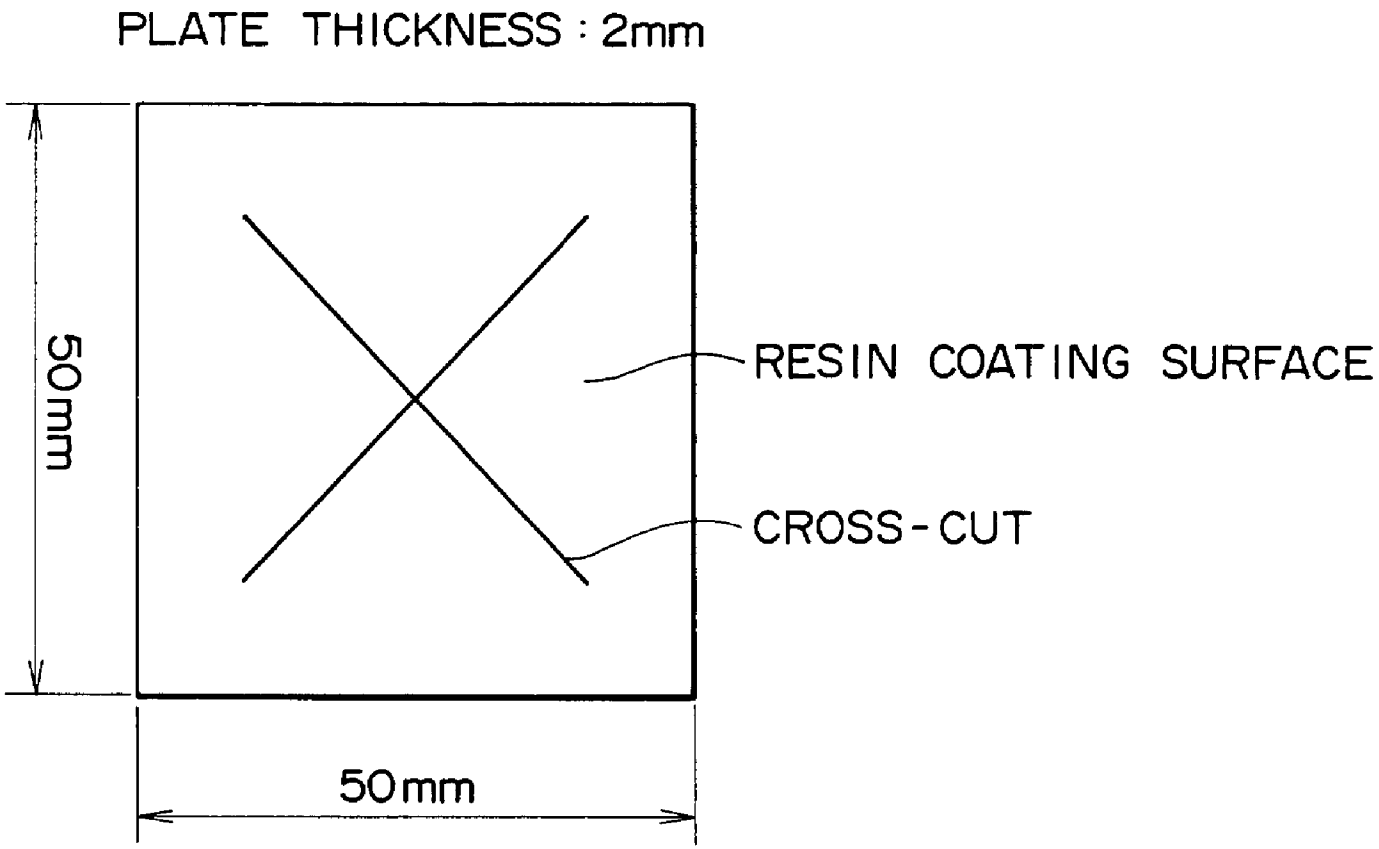
FIG. 6 is a figure showing the shape of the specimen subjected to the accelerated test and the atmospheric exposure test.

Steel sheets were prepared, each having the chemical composition as shown in Table 1. They were painted with resin paints as shown in Table 2. The painted film on the steel plate was given a cross cut as shown in FIG. 6. The samples with a cross cut (artificial coating defect) were examined for long-term durability by means of accelerated test and atmospheric exposure test.

The painted film on the steel sheet was preceded by sand blasting for surface preparation, and the painting was accomplished by spraying so that a painted film thickness of 10 μm was attained. In Table 2 showing paints, B denotes butyral resin, P denotes polyester resin, E denotes epoxy resin, U denotes urethane resin, and F denotes fluorine resin.

The accelerated test consists of three steps of (1) irradiation with a carbon arc lamp, (2) dipping in saltwater (0.1%, 0.5%, and 3.0%), and (3) keeping at constant temperature and constant humidity, which are turned sequentially 60 cycles.

After the accelerated test, the samples were examined for external appearance and corrosion spreading from the cross cut in the painted film.

The atmospheric exposure test consists of exposing the samples (directed southward and inclined 30° to the horizontal) to the atmosphere for one year. After the atmospheric exposure test, the samples were examined for external appearance and corrosion spreading from the cross-cut in the painted film.

Corrosion was rated by measuring the width of corrosion spread at eight points and expressed in terms of average.

The appearance was rated on a scale of one to ten, with one indicating the severest damage (or corrosion on the entire surface) and ten indicating the best appearance. The relative overall judgment is indicated by ⊚, ○, Δ, and X.

The results are shown in Table 2.

It is apparent from Table 2 that the painted steel plates according to the present invention are by far superior to the comparative steel plates, Comparative Examples 1 to 3 are explained below.

No. 1 represents plain steel. No. 2 represents so-called corrosion-resistant steel. Since it contains Cr, it has widely spread corrosion due to a lowered pH. No. 3 represents a steel which does not contain any element (functioning like Cr) which promotes the formation of stable rust and moderate the decrease in pH. Hence it is poor in corrosion resistance. The results shown in Table 2 prove the usefulness of the present invention.

TABLE 1

| | Chemical composition (mass %) | | | | | | | | | | | | | | | |
|---|---|---|---|---|---|---|---|---|---|---|---|---|---|---|---|---|
| Steel | C | Si | Mn | P | S | Cu | Ni | Cr | Ti | Al | Ca | Others | Cu + Ni | $P_{CM}$ | Ti/C | Remarks |
| 1 | 0.09 | 0.21 | 1.15 | 0.010 | 0.003 | 0.01 | 0.01 | 0.03 | — | 0.026 | — | — | 0.02 | 0.16 | — | Comparative |
| 2 | 0.12 | 0.20 | 0.75 | 0.015 | 0.003 | 0.36 | 0.21 | 0.50 | — | 0.024 | — | — | 0.57 | 0.21 | — | Comparative |
| 3 | 0.11 | 0.22 | 0.66 | 0.021 | 0.004 | 0.34 | 0.23 | 0.02 | — | 0.023 | — | — | 0.57 | 0.17 | — | Comparative |
| 4 | 0.11 | 0.22 | 0.66 | 0.021 | 0.024 | 3.50 | 0.80 | 0.01 | 0.080 | 0.024 | — | — | 4.30 | 0.34 | 0.7 | Comparative |
| 5 | 0.15 | 0.25 | 1.40 | 0.010 | 0.007 | 0.35 | 0.22 | 0.02 | 0.050 | 0.030 | — | — | 0.57 | 0.25 | 0.3 | Comparative |
| 6 | 0.05 | 0.35 | 1.46 | 0.007 | 0.002 | 0.54 | 0.31 | 0.03 | 0.030 | — | — | — | 0.85 | 0.17 | 0.6 | Example |
| 7 | 0.04 | 0.35 | 1.46 | 0.007 | 0.002 | 0.54 | 0.31 | 0.03 | 0.070 | — | — | — | 0.85 | 0.16 | 1.8 | Example |
| 8 | 0.02 | 0.35 | 1.65 | 0.010 | 0.007 | 0.55 | 0.30 | 0.03 | 0.110 | — | — | — | 0.85 | 0.15 | 5.5 | Example |
| 9 | 0.01 | 0.20 | 0.52 | 0.010 | 0.007 | 2.23 | 2.50 | 0.03 | 0.050 | — | — | — | 4.73 | 0.21 | 5.0 | Example |
| 10 | 0.01 | 0.25 | 1.60 | 0.010 | 0.007 | 0.35 | 5.53 | 0.03 | 0.051 | — | — | — | 5.88 | 0.22 | 5.1 | Example |
| 11 | 0.02 | 0.35 | 1.65 | 0.010 | 0.007 | 0.55 | 0.30 | 0.03 | 0.070 | 2.05 | — | — | 0.85 | 0.15 | 3.5 | Example |
| 12 | 0.05 | 0.25 | 1.45 | 0.010 | 0.007 | 0.35 | 0.20 | 0.03 | 0.050 | 0.082 | 0.0035 | La: 0.004 | 0.55 | 0.15 | 1.0 | Example |
| 13 | 0.05 | 0.25 | 1.45 | 0.010 | 0.007 | 0.40 | 0.20 | 0.03 | 0.080 | — | 0.0015 | Ce: 0.0050 | 0.60 | 0.16 | 1.6 | Example |
| 14 | 0.05 | 0.35 | 1.23 | 0.007 | 0.002 | 0.55 | 0.30 | 0.03 | 0.045 | — | — | B: 0.0007 | 0.85 | 0.16 | 0.9 | Example |
| 15 | 0.06 | 0.25 | 1.70 | 0.010 | 0.007 | 0.45 | 0.20 | 0.03 | 0.080 | — | — | B:0.0025 | 0.65 | 0.19 | 1.3 | Example |
| 16 | 0.05 | 0.25 | 1.51 | 0.010 | 0.007 | 0.51 | 0.20 | 0.03 | 0.050 | — | — | B: 0.0016<br>Nb: 0.012 | 0.71 | 0.17 | 1.0 | Example |
| 17 | 0.08 | 0.25 | 1.45 | 0.010 | 0.007 | 0.55 | 0.20 | 0.03 | 0.050 | — | — | V: 0.053<br>Mo: 0.20 | 0.75 | 0.20 | 0.6 | Example |
| 18 | 0.11 | 0.25 | 1.45 | 0.010 | 0.007 | 0.35 | 0.22 | 0.03 | 0.050 | — | 0.0025 | B: 0.0008<br>Mo: 0.012 | 0.57 | 0.22 | 0.5 | Example |
| 19 | 0.05 | 0.25 | 1.45 | 0.010 | 0.007 | 0.50 | 0.20 | 0.03 | 0.050 | 0.105 | 0.0035 | Nb: 0.03<br>V: 0.035<br>Zr: 0.013 | 0.70 | 0.16 | 1.0 | Example |

TABLE 2

| | | Accelerated test (0.1% salt water) | | | Accelerated test (0.5% salt water) | | | Accelerated test (3.0% salt water) | | | Atmospheric exposure test | | | | |
|---|---|---|---|---|---|---|---|---|---|---|---|---|---|---|---|
| Steel | Paint | Appearance (RN) | Corrosion spread (mm) | Rating | Appearance (RN) | Corrosion spread (mm) | Rating | Appearance (RN) | Corrosion spread (mm) | Rating | Appearance (RN) | Corrosion spread (mm) | Rating | Overall rating | Remarks |
| 1 | B | 3 | 1.48 | X | | | | | | | 6 | 0.53 | X | X | Comparative |
| 2 | B | 4 | 1.64 | X | | | | | | | 7 | 0.44 | X | X | Comparative |
| 3 | B | 2 | 2.02 | X | | | | | | | 7 | 0.52 | X | X | Comparative |
| 4 | B | — | — | | — | — | | — | — | | — | — | | X | Comparative |
| 5 | B | 10 | <0.50 | ⊚ | 8 | 0.70 | ○ | 7 | 0.67 | Δ | 9 | 0.24 | ⊚ | ○ | Comparative |
| 6 | B | 9 | <0.51 | ⊚ | 7 | 0.84 | Δ | | | | 9 | 0.26 | ○ | ○ | Example |
| 7-1 | B | 10 | <0.50 | ⊚ | 10 | 0.61 | ⊚ | 9 | 0.55 | ⊚ | 10 | 0.23 | ⊚ | ⊚ | Example |
| 7-2 | P | 10 | <0.50 | ⊚ | 8 | 0.66 | ○ | | | | 9 | 0.22 | ⊚ | ⊚ | Example |
| 7-3 | E | 10 | <0.50 | ⊚ | 8 | 0.68 | ○ | | | | 9 | 0.23 | ⊚ | ⊚ | Example |
| 7-4 | U | 10 | <0.50 | ⊚ | 8 | 0.64 | ○ | | | | 9 | 0.20 | ⊚ | ⊚ | Example |
| 7-5 | F | 10 | <0.50 | ⊚ | 8 | 0.66 | ○ | | | | 9 | 0.21 | ⊚ | ⊚ | Example |
| 8 | B | 10 | <0.50 | ⊚ | 10 | 0.61 | ⊚ | 9 | 0.55 | ⊚ | 10 | 0.23 | ⊚ | ⊚ | Example |
| 9 | B | 10 | <0.50 | ⊚ | 10 | 0.51 | ⊚ | | | | 10 | 0.18 | ⊚ | ⊚ | Example |
| 10 | B | 10 | <0.50 | ⊚ | 10 | 0.50 | ⊚ | | | | 10 | 0.18 | ⊚ | ⊚ | Example |
| 11 | B | 10 | <0.50 | ⊚ | 8 | 0.64 | ○ | 8 | 0.60 | Δ | 9 | 0.20 | ○ | ○ | Example |
| 12 | B | 10 | <0.50 | ⊚ | 8 | 0.68 | ○ | 7 | 0.62 | Δ | 10 | 0.21 | ○ | ○ | Example |

TABLE 2-continued

| Steel | Paint | Accelerated test (0.1% salt water) Appearance (RN) | Corrosion spread (mm) | Rating | Accelerated test (0.5% salt water) Appearance (RN) | Corrosion spread (mm) | Rating | Accelerated test (3.0% salt water) Appearance (RN) | Corrosion spread (mm) | Rating | Atmospheric exposure test Appearance (RN) | Corrosion spread (mm) | Rating | Overall rating | Remarks |
|---|---|---|---|---|---|---|---|---|---|---|---|---|---|---|---|
| 13 | B | 10 | <0.50 | ◎ | 10 | 0.53 | ◎ | 10 | 0.54 | ◎ | 10 | 0.19 | ◎ | ◎ | Example |
| 14 | B | 10 | <0.50 | ◎ | 10 | 0.60 | ◎ | 9 | 0.55 | ◎ | 10 | 0.20 | ◎ | ◎ | Example |
| 15 | B | 10 | <0.50 | ◎ | 10 | 0.62 | ◎ | 9 | 0.56 | ◎ | 10 | 0.21 | ◎ | ◎ | Example |
| 16 | B | 10 | <0.50 | ◎ | 10 | 0.62 | ◎ | 8 | 0.60 | ○ | 10 | 0.24 | ◎ | ◎ | Example |
| 17 | B | 10 | <0.50 | ◎ | 10 | 0.62 | ◎ | 8 | 0.60 | ○ | 10 | 0.24 | ◎ | ◎ | Example |
| 18 | B | 11 | <0.51 | ◎ | 10 | 0.64 | ◎ | 9 | 0.55 | ○ | 10 | 0.20 | ◎ | ◎ | Example |
| 19 | B | 12 | <0.52 | ◎ | 10 | 0.56 | ◎ | 10 | 0.50 | ◎ | 10 | 0.16 | ◎ | ◎ | Example |

EXAMPLE 2

Steel billets were prepared, each having the chemical composition as shown in Table 1. They were made into steel plates (25–80 mm thick) under the conditions shown in Table 3. The resulting steel plates were tested for tensile strength, low-temperature toughness, preheating temperature to prevent weld crack (according to JIS Z-3158), and toughness of the heat affected zone. The results are shown in Table 3. For the last item mentioned above, a weld joint was made by electro-gas arc welding (with heat input of 120 kJ/cm). Toughness was measured at three points: one at the bond (boundary between the welded metal and the base metal), one 1 mm from the bond toward the base metal, and one 3 mm from the bond toward the base metal. The lowest value of three measurements was accepted.

Sample No. 5 (as comparative example) has a high value of $P_{CM}$ and hence has a preheating temperature to prevent weld cracking which is as high as 100° C. In addition, it has a low value of toughness (20 J) at the part affected by welding heat.

Sample No. 7-6 (as comparative example) has a heating temperature which is higher than that specified in the present invention. Sample No. 7-7 (as comparative example) has a finish rolling temperature which is higher than that specified in the present invention. Therefore, they do not meet the requirement that the base metal should have a value of toughness greater than 100 J (their values are 60 J and 80 J, respectively). Samples Nos. 8-1 and 8-2 (as comparative examples) have the Ti/C ratio exceeding 4. The former has a heating temperature which is higher than that specified in the present invention. The latter has a finish rolling temperature which is higher than that specified in the present invention. Therefore, they do not meet the requirement that the base metal should have a value of toughness greater than 100 J (their values are 85 J and 76 J, respectively).

Sample No. 15-1 (as comparative example) has the Ti/C ratio exceeding 4. It has a quenching temperature which is higher than that specified in the present invention. Therefore, its base metal has a value of toughness lower than 80 J.

Examples according to the present invention are superior in base metal characteristics, preheating temperature to prevent weld crack, and toughness of the heat affected zone, regardless of whether the Ti/C ratio it higher than 4 or lower than 4, as shown in Table 2.

Samples Nos. 15-2 and 19 (as examples) were obtained by hot rolling which was followed by direct quenching. They gave the same results as obtained in the case where reheating quenching was carried out according to the present invention.

TABLE 3

| Steel | Ti/C | Plate thickness (mm) | 1200 − 50 × Ti/C (° C.) | $Ar_3$ + 50 × Ti/C + 100 × $Ni^2$ (° C.) | $Ac_3$ + 50 × Ti/C + 100 × $Ni^2$ (° C.) | Heating temperature (° C.) | Finish rolling temperature (° C.) | Cooling method | Hardening temperature (° C.) (DQ: direct quenching) | Annealing temperature (° C.) |
|---|---|---|---|---|---|---|---|---|---|---|
| 5 | 0.3 | 25 | 1185 | 758 | 853 | 1100 | 800 | Air cooling | | |
| 6 | 0.6 | 25 | 1170 | 795 | 893 | 1050 | 780 | Air cooling | | |
| 7 | 1.8 | 25 | 1110 | 858 | 955 | 1050 | 780 | Water colling | | |
| 7-6 | 1.8 | 25 | 1110 | 858 | 955 | 1200 | 800 | Water cooling | | |
| 7-7 | 1.6 | 25 | 1110 | 858 | 955 | 1050 | 1000 | Water cooling | | |
| 7-8 | 1.8 | 50 | 1110 | 858 | 955 | 1050 | 780 | Water cooling | | |
| 8 | 5.5 | 25 | — | $Ar_3$; 750 | $Ac_3$; 855 | 1100 | 900 | Water cooling | | |
| 8-1 | 5.5 | 25 | — | $Ar_3$; 750 | $Ac_3$; 855 | 1250 | 910 | Water cooling | | |
| 8-2 | 5.5 | 25 | — | $Ar_3$; 750 | $Ac_3$; 855 | 1100 | 1000 | Water cooling | | |
| 9 | 5.0 | 25 | — | $Ar_3$; 689 | $Ac_3$; 841 | 1100 | 900 | Air cooling | | |
| 10 | 5.1 | 25 | — | $Ar_3$; 473 | $Ac_3$; 735 | 1100 | 880 | Air cooling | | |
| 11 | 3.5 | 25 | 1025 | 934 | 1039 | 1000 | 880 | Water cooling | | |
| 12 | 1.0 | 25 | 1150 | 820 | 908 | 1100 | 800 | Water cooling | | |
| 13 | 1.6 | 25 | 1120 | 849 | 938 | 1100 | 820 | Water cooling | | |
| 14 | 0.9 | 25 | 1155 | 828 | 861 | 1050 | 780 | Air cooling | | |
| 15 | 1.3 | 25 | 1135 | 811 | 913 | 1050 | 760 | Air cooling | 880 | 640 |
| 15-1 | 1.3 | 25 | 1135 | 811 | 913 | 1050 | 760 | Air cooling | 930 | 640 |
| 15-2 | 1.3 | 80 | 1135 | 811 | 913 | 1050 | 760 | Water cooling | DQ | 640 |
| 16 | 1.0 | 25 | 1150 | 813 | 907 | 1050 | 760 | Air cooling | 880 | 640 |
| 17 | 0.6 | 25 | 1170 | 789 | 866 | 1050 | 760 | Air cooling | 870 | 640 |

TABLE 3-continued

| | | | | | | | | | | |
|---|---|---|---|---|---|---|---|---|---|---|
| 18 | 0.5 | 25 | 1175 | 776 | 870 | 1050 | 760 | Air cooling | 860 | 640 |
| 19 | 1.0 | 50 | 1150 | 817 | 910 | 950 | 760 | Water cooling | DQ | 640 |

| | Base metal characteristics | | | | Charpy | |
|---|---|---|---|---|---|---|
| Steel | Yield strength ($N/mm^2$) | Tensile strength ($N/mm^2$) | $VE_0$ (J) | Preheating temperature to protect weld crack (° C.) (RT: room temperature) | V-notch impact properties $VE_0$ (J) | Remarks |
| 5 | 453 | 555 | | 100 | 20 | Comparative |
| 6 | 435 | 510 | >300 | <RT | 110 | Example |
| 7 | 476 | 573 | >300 | <RT | 100 | Example |
| 7-6 | 460 | 585 | 60 | <RT | | Comparative |
| 7-7 | 453 | 603 | 80 | <RT | | Comparative |
| 7-8 | 456 | 563 | >300 | <RT | 110 | Example |
| 8 | 335 | 466 | >300 | <RT | 110 | Example |
| 8-1 | 355 | 480 | 85 | <RT | | Comparative |
| 8-2 | 363 | 503 | 76 | <RT | | Comparative |
| 9 | 430 | 520 | >300 | <RT | 110 | Example |
| 10 | 435 | 534 | >300 | <RT | 115 | Example |
| 11 | 441 | 598 | >300 | <RT | 110 | Example |
| 12 | 445 | 536 | >300 | <RT | 120 | Example |
| 13 | 437 | 533 | >300 | <RT | 120 | Example |
| 14 | 450 | 515 | >300 | <RT | 185 | Example |
| 15 | 556 | 628 | >300 | <RT | 170 | Example |
| 15-1 | 568 | 645 | 80 | <RT | | Comparative |
| 15-2 | 528 | 625 | >300 | <RT | 150 | Example |
| 16 | 560 | 633 | >300 | <RT | 150 | Example |
| 17 | 550 | 628 | >300 | <RT | 115 | Example |
| 18 | 563 | 635 | >300 | <RT | 155 | Example |
| 19 | 551 | 635 | >300 | <RT | 120 | Example |

What is claimed is:

1. A resin-paintable steel plate for paint use which contains C (0.04 to 0.12%), Si (1.0% or less, excluding 0%), Mn (2.5% or less, excluding 0%), P (0.05% or less, excluding 0%), S (0.02% or less, excluding 0%), Cr (0.05% or less, excluding 0%), Cu (0.05–3.0%), Ni (0.05–6.0%), Ti (0.025–0.15%), Al (0.05–0.50%), Cu+Ni (0.50% or more), and $P_{CM}$ (0.23% or less), in terms of mass %.

2. A steel plate for paint use as defined in claim 1, which further contains at least one additional component selected from Ca (0.0001–0.05%), Ce (0.0001–0.05%), and La (0.0001–0.05%), in terms of mass %.

3. A steel plate for paint use as defined in claim 1, which further contains B (0.0005–0.0030%), in terms of mass %.

4. A steel plate for paint use as defined in claim 2, which further contains B (0.0005–0.0030%), in terms of mass %.

5. A steel plate for paint use as defined in claim 1, which further contains at least one additional component selected from Nb (0.002–0.05%), V (0.01–0.10%), Zr (0.002–0.05%), and Mo (0.05–0.5%), in terms of mass %.

6. A steel plate for paint use as defined in claim 2, which further contains at least one additional component selected from Nb (0.002–0.05%), V (0.01–0:10%), Zr (0.002–0.05%), and Mo (0.05–0.5%), in terms of mass %.

7. A steel plate for paint use as defined in claim 3, which further contains at least one additional component selected from Nb (0.002–0.05%), V (0.01–0.10%), Zr (0.002–0.05%), and Mo (0.05–0.5%), in terms of mass %.

8. A steel plate for paint use as defined in claim 4, which further contains at least one additional component selected from Nb (0.002–0.05%), V (0.01–0.10%), Zr (0.002–0.05%), and Mo (0.05–0.5%), in terms of mass %.

9. A steel plate for paint use as defined in claim 1, wherein the content of Cr is not more than 0.03%, in terms of mass %.

10. A steel plate for paint use as defined in claim 1, wherein the content of Cu+Ni is 1.0% or more, in terms of mass %.

11. A steel plate for paint use as defined in claim 1, wherein the content of Cu+Ni is 0.85 % or more, in terms of mass %.

12. A manufacturing method of a steel plate for paint use, said process comprising hot-rolling a steel plate which is defined in claim 1 and contains Ti and C in such an amount that the Ti/C ratio exceeds 4, in such a way that the heating temperature is 850–1200° C. and the temperature at the end of rolling is 950° C. or lower, said hot rolling being followed by air cooling or water cooling (at a cooling rate 1° C./s or higher).

13. A manufacturing method of a steel plate for paint use, said process comprising hot-rolling a steel plate which is defined in claim 1 and contains Ti and C in such an amount that the Ti/C ratio exceeds 4, in such a way that the heating temperature is 850–1200° C. and the temperature at the end of rolling is 950° C. or lower, said hot rolling being followed by direct quenching from a temperature of $Ar_3$~950° C. or reheating-quenching from a temperature of $Ac_3$~950° C., and tempering.

14. A manufacturing method of a steel plate for paint use, said process comprising hot-rolling a steel plate which is defined in claim 1 and contains Ti and C in such an amount that the Ti/C ratio is 4 or less, in such a way that the heating temperature is 850~(1200−50×Ti/C) ° C. and the temperature at the end of rolling is $(Ar_3+50\times Ti/C+100\times[Ni]^2)$ ° C. or lower, which is followed by air cooling or water cooling (at a cooling rate 1° C./s or higher) (where [Ni] represents the content of Ni).

15. A manufacturing method of a steel plate for paint use, said process comprising hot-rolling a steel plate which is defined in claim 1 and contains Ti and C in such an amount that the Ti/C ratio is 4 or less, in such a way that the heating temperature is 850~(1200−50×Ti/C)° C. and the temperature at the end of rolling is ($Ar_3$+50×Ti/C+100×$[Ni]^2$) ° C. or lower, which is followed by direct quenching from a temperature at the end of rolling or reheating-quenching from a temperature of ($Ac_3$+50×Ti/C+100×$[Ni]^2$)° C. or lower, and tempering (where [Ni] represents the content of Ni).

* * * * *

UNITED STATES PATENT AND TRADEMARK OFFICE

CERTIFICATE OF CORRECTION

PATENT NO. : 7,037,388 B2
APPLICATION NO. : 10/265646
DATED : May 2, 2006
INVENTOR(S) : Kan et al.

It is certified that error appears in the above-identified patent and that said Letters Patent is hereby corrected as shown below:

On the title page, the Foreign Application Priority Data is incorrect. Item (30) should read:

-- (30) Foreign Application Priority Data

Sep. 30, 1998 (JP) ..... 10-277716
Dec. 25, 1998 (JP) ..... 10-370422 --

Also, on the title page, item (73) the Assignee should read as follows:

-- Assignee: Kabushiki Kaisha Kobe Seiko Sho (Kobe Steel, Ltd.), Kobe (JP) --

Signed and Sealed this

Eighteenth Day of July, 2006

JON W. DUDAS
*Director of the United States Patent and Trademark Office*